United States Patent [19]

Signorelli et al.

[11] 4,040,279

[45] Aug. 9, 1977

[54] SECURITY LOCK AND KEY

[76] Inventors: John A. Signorelli, 2150 E. 29th St., Brooklyn, N.Y. 11229; Paul Z. Haus, Jr., 787 Hartwell St., Teaneck, N.J. 07666

[21] Appl. No.: 728,943

[22] Filed: Oct. 4, 1976

[51] Int. Cl.[2] ..... E05B 67/36

[52] U.S. Cl. ..... 70/34; 70/395; 70/422

[58] Field of Search ..... 70/32, 33, 34, 23, 395, 70/397, 398, 386, 422; 292/252

[56] References Cited

U.S. PATENT DOCUMENTS

| | | | |
|---|---|---|---|
| 3,478,548 | 11/1969 | Finck | 70/397 |
| 3,714,802 | 2/1973 | Morse | 70/34 |
| 3,835,674 | 9/1974 | Hoyt | 70/34 |

*Primary Examiner*—Robert L. Wolfe
*Attorney, Agent, or Firm*—Brooks, Haidt, Haffner & Delahunty

[57] ABSTRACT

Attempts to pick the plunger-type (barrel) lock disclosed are frustrated by the necessity of holding one axially movable part in place against the force of a spring while retracting another axially movable member to open the lock. The key that opens the lock has a central pin stationary in use for holding back a position while radially spreading fingers frictionally engage and thereby permit withdrawal of an axially movable cylinder coaxial with the piston. A frangible member is provided for installing the lock without using the special key so that the number of keys can be strictly controlled. The key will open not only the lock of this invention, but also other kinds of plunger-type locks in common use by gas and electric utility companies.

23 Claims, 16 Drawing Figures

10
11
12
13
14
15
16
17
18
20
21
22
23
24
25
26
27
28

25
49
42
39
28'
50
33
40
37
34
36
32
30
41
16
43
20'
28'
15
51
14

25
49
42
39
54
50
52
33
37
38
32
44
16
40
41
51
43
20
28
32
34
14
51
15

25
42
17
39
10
50
33
11
38
40
36
51
16
12
41
43
49
18
14
15

13
25
42
39
33
35
14
37
36
40
34
44
16
41
43
49
45
46
50
14
30
32
44
16
31
14
13

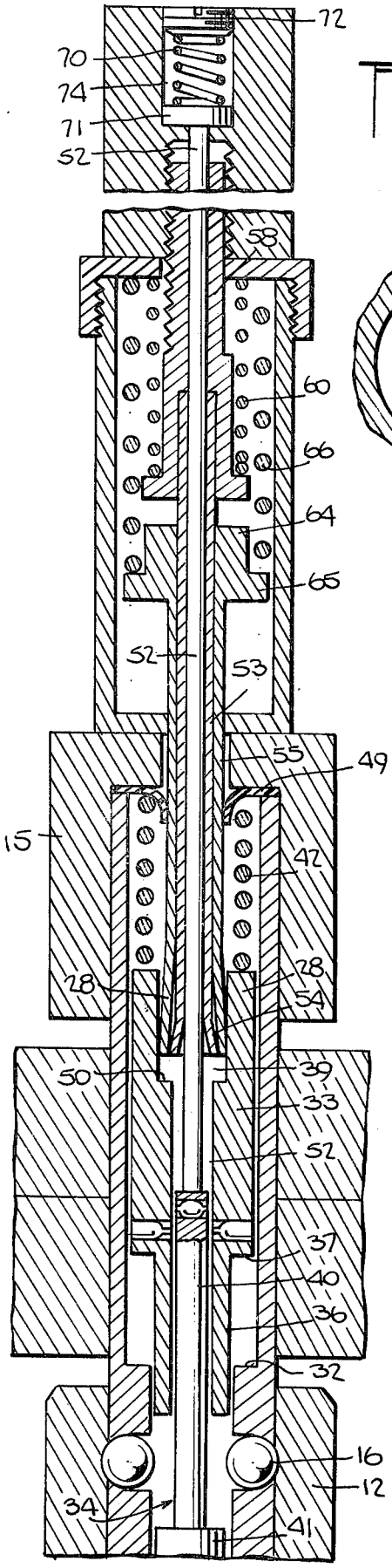
Fig. 10.
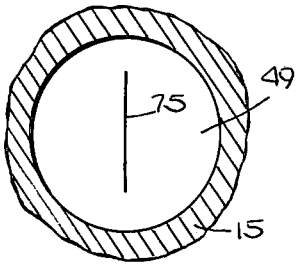
Fig. 13.
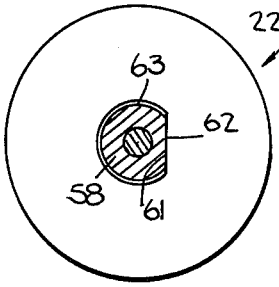
Fig. 16.
Fig. 9.
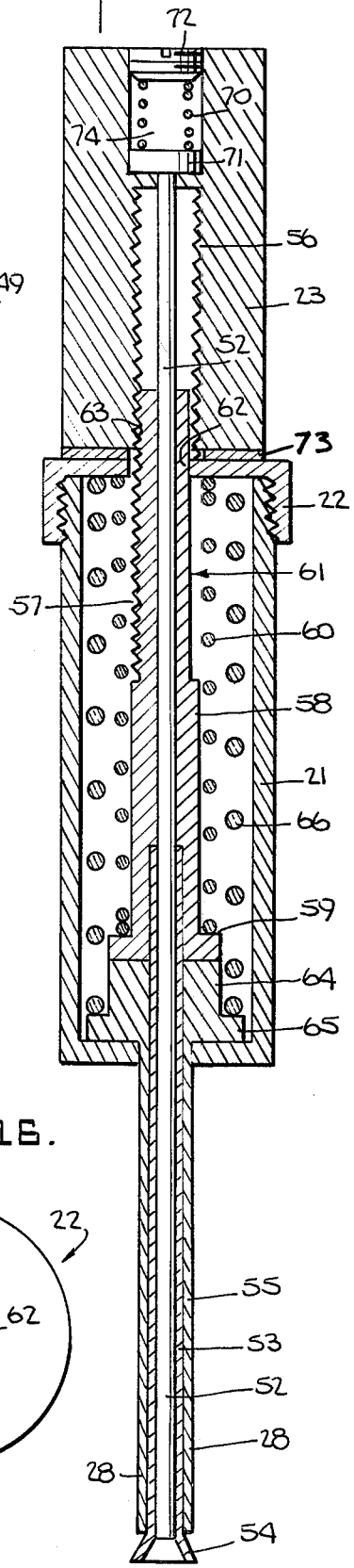

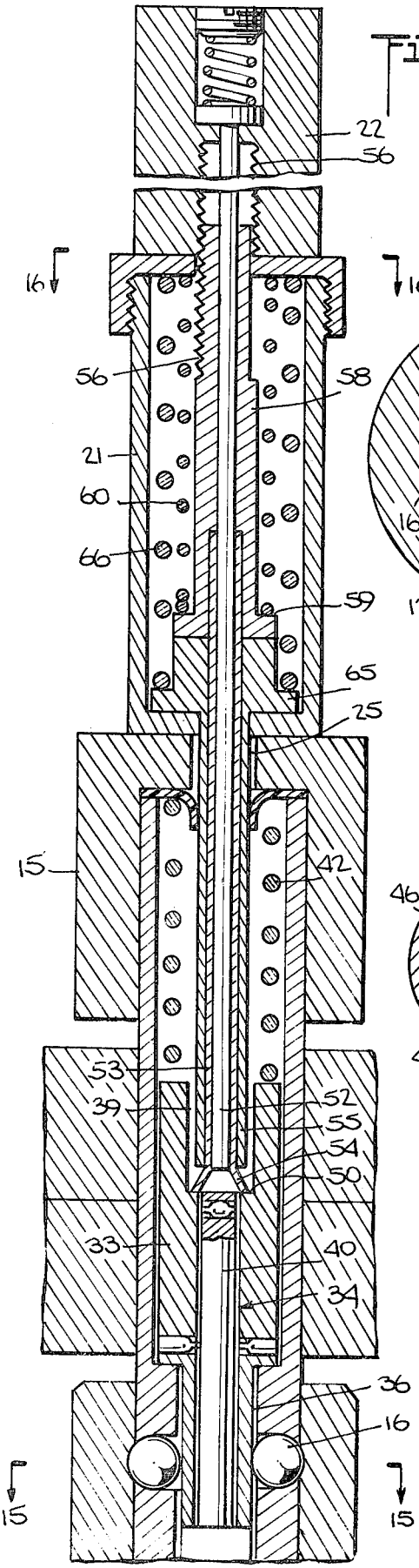
Fig. 11.
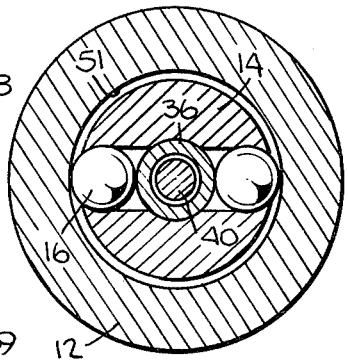
Fig. 15.
Fig. 14.
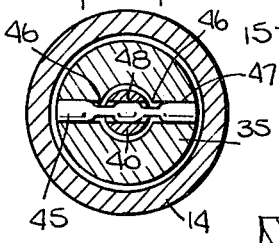
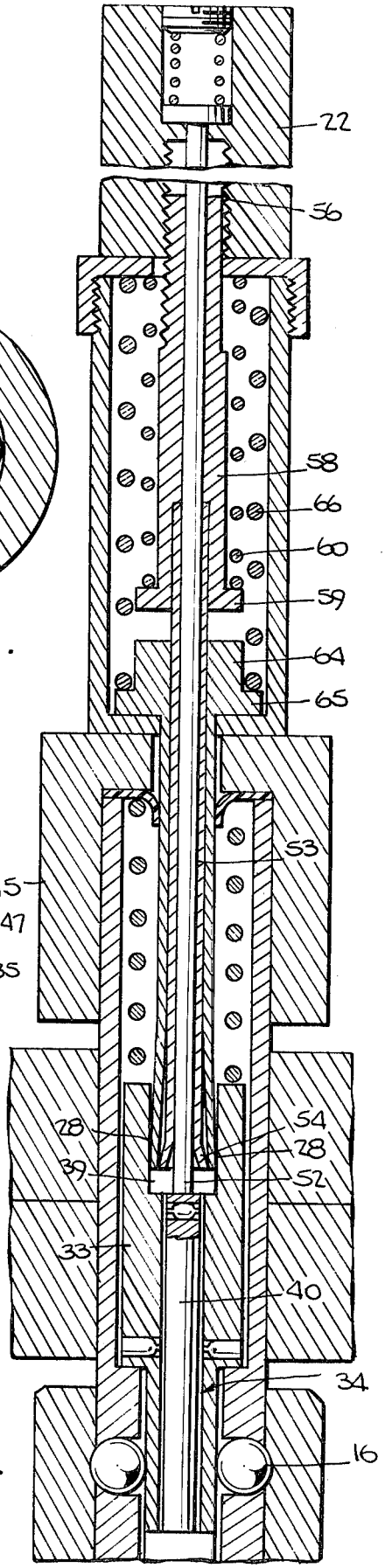
Fig. 12.

SECURITY LOCK AND KEY

BACKGROUND OF THE INVENTION

1. Field of the Invention

The invention relates to plunger-type or barrel locks and keys.

2. Description of the Prior Art

Locks having internal spring-loaded axially movable plungers and radially extending locking members such as steel balls, are widely used to prevent tampering with gas and electric meters. Examples of such locks, called generally plunger-type locks throughout this specification are shown in U.S. Pat. Nos. 1,923,025 and 3,714,802 to Morse et al; 3,002,368 and 3,033,016 to Moberg; and 3,835,674 to Hoyt. The locks of all of the foregoing patents are intended to prevent unlocking by any means other than the proper key. The ingenuity and resourcefulness of those who seek unauthorized access to electric and gas meters and shutoff switches and valves, learned through sad experience by utility companies, have been countered by advances in the technology of locks of the plunger type.

Morse et al U.S. Pat. No. 1,923,025 shows a plunger-type lock and key in which threads on the key mate with internal threads of a spring-loaded plunger for retraction of the plunger.

The lock of Moberg U.S. Pat. No. 3,002,368 was designed to be opened with a key shown in Moberg U.S. Pat. No. 3,033,016, which has a pair of fingers that are spread apart within a bore of the lock's plunger to engage frictionally and permit retraction of the plunger.

Morse et al U.S. Pat. No. 3,714,802, noting that the locks of the Morse et al. and Moberg patents discussed above have been attacked with occasional success by the use of a wire with a return bend at its end, proposed the insertion of a relatively free and slidable sleeve within the axial bore of the lock plunger to thwart bent-wire lock-pickers by requiring a greater degree of radially expanding force. This patent also suggests limiting the depth of the bore in the lock's plunger.

Hoyt U.S. Pat. No. 3,835,674 is directed to defense against the lock picker who hammers a nail into the plunger bore of the previously described locks and thus attains sufficient engagement to retract the plunger and free the locking balls to open the lock. Hoyt's plunger is made in two parts, one of which must be retracted while the other remains in place to open the lock so that the nail-hammering lock-picker would wedge both parts together and retract both parts in a vain attempt to tamper with a meter. The piece which is to be left behind in opening Hoyt's lock has a conical point facing the keyhole. However, the limited cavity provided by the plunger bore of the Hoyt lock makes gripping the plunger, even with the authorized key difficult, especially is someone has damaged the lock by attempting to pick it. If the conical point on the central member of Hoyt's lock has been bent over to engage the cylinder by a hammering lockpicker, even the authorized key cannot open the lock. Foreign matter can lodge in the bore of Hoyt's lock, hampering operation and preventing opening of the lock with its proper key, so that when an authorized person removes the lock, he may be required to destroy parts held by the lock.

It has also been found that some locks using keys of the internal frictional engagement type can be opened by means of a device of the type shown in U.S. Pat. No. 1,656,180, and though the casual tamperer probably does not have such a tool, it is available and may be used by the more experienced practitioner of the lock-picking art.

The prior art locks will succumb to brute force of sufficient violence or to some combination of skill and luck on the part of the lock-picker, but entirely aside from these problems is the unauthorized possession and use of the key designed for the lock. The loss or theft of a key exposes to unauthorized entry the many locks for which the key is intended, and despite vigilance in restricting access to keys, there have been cases in which keys have been unlawfully used.

The security problem of lost and stolen keys has been difficult to combat because not only those who must open the lock but also those who install locks of the prior art types discussed by way of example, ordinarily have authorized keys for the locks. Because personnel are required to have keys for the prior art locks, control, record keeping and administration related to the keys has been difficult.

The foregoing drawbacks of conventional plunger-type lock and key systems evidence the present need for a pick resistant plunger-type lock that cannot be opened by existing keys, but which can be opened by means of a key which will also open existing locks, facilitating a "master key" concept.

SUMMARY OF THE INVENTION

The plunger-type security lock of the present invention can be installed without using a key, thereby greatly reducing the number of keys in circulation and the potential for loss or theft of keys. The lock cannot be opened by techniques now being unlawfully practiced nor by means of keys used for conventional locks, but the key of the present invention will open the commonly used plunger-type locks. These advantages are achieved without substantially increasing the complexity or cost of the lock. The lock of the invention can be sized to replace existing locks on meters, switches, cabinets and the like. The external and internal parts of the lock are preferably formed of hardened steel.

Like plunger-type locks currently in use, the lock of the invention has a generally cylindrical shank with an enlarged head fixedly secured at one end of the shank, or integrally formed therewith. The head has a keyhole aperture. Within the shank there is an axially slidable plunger mechanism spring loaded by a coiled locking spring away from the head to hold two steel balls in radially extended positions at opposite ends of a transverse bore in which condition the balls engage cooperating structure such as grooves in a cap or the like, locking the shank in place. The plunger mechanism must be retracted to free the balls to move radially inward for unlocking. The plunger mechanism, unlike those of most conventional plunger-type locks, has two coaxially arranged parts formed generally as a piston and cylinder, and a coiled tamper prevention spring mounted within the shank remote from the head, bears on the piston and urges the piston to follow the cylinder when the cylinder is retracted toward the head end of the shank. So long as the piston and cylinder move together the steel balls stay in their extended locking position.

In order to open the lock, the piston of the plunger mechanism must be restrained from moving with the cylinder while the cylinder is retracted, so that the steel balls are free to move inward into a space normally occupied by the cylinder. The techniques that have been employed for picking conventional plunger-type locks will not produce the combined effects of withdrawing the cylinder of the plunger mechanism against the force exerted by the locking spring while holding the piston stationary against the urging of the tamper prevention spring.

The plunger of the aforementioned Hoyt U.S. Pat.No. 3,835,674 is in two parts, so that when a key with an operably expanding end is employed, one part only of the plunger will be retracted, leaving the other part in place. It is intended by Hoyt that when a nail or other lock-picking means is driven into the plunger both parts of the plunger would be withdrawn together, but there is not positively acting means in the Hoyt lock for causing both parts of the plunger to move together. On the contrary, the Hoyt patent suggests that air pressure or an oil seal will restrain the second part of the plunger from following the first part in retraction for unlocking. In the lock of the present invention, the tamper prevention spring produces following movement unless the piston is firmly held in place when the cylinder is retracted.

The key of the present invention is so structured that a central rod-like member of the key holds the piston of the lock stationary against the thrust of the tamper prevention spring while outwardly expanding elements are spread apart to engage the plunger cylinder and then retract the cylinder to open the lock while the piston is held stationary. Keys of the prior art do not have any part that remains stationary while moving elements act to retract a lock plunger, and accordingly prior art keys cannot open the lock of the invention. However, the key of this invention has outwardly spreading elements that can frictionally engage and retract plungers of the conventional plunger-type locks, so the key can be used for existing locks as well as the locks of this invention.

In the presently preferred embodiment, the key of the invention has a central rod-like element which remains stationary after the insertion of the key into the lock. Concentric with the rod-like member is a tubular sleeve tht terminates in a flared end, and a pair of relatiely flexible fingers of generally semi-circular profile are positioned outwardly alongside the tubular sleeve. When the tubular sleeve is moved outward toward the keyhole of the lock, its flared end portion will wedge the fingers radially away from the axis of the rod-like central member and into frictional engagement with the wall of a bore of the plunger cylinder. Further outward movement of the tubular sleeve will draw the fingers and the plunger cylinder along, retracting the cylinder while leaving the plunger piston held in place by the stationary central rod-like member, thus freeing the locking steel balls to move radially inward to their unlocking positions.

The means for actuating the tubular sleeve and engaging fingers in operation of the key, according to the presently preferred embodiment of the invention comprises a rotatable thumb screw having internal threads cooperating with external threads of an element secured to the end of the tubular sleeve remote from the flared end of the sleeve. The externally threaded element, and a bias spring tending to oppose retraction of the tubular sleeve are housed within a generally cylindrical handle portion of the key. Another bias spring within the key handle portion opposes retracting motion of the spreading engagement fingers so that those fingers do not move along with the tubular sleeve until the finger ends are wedged into tight frictional engagement between the flared end of the sleeve and the wall of the plunger cylinder bore.

Since it has been found desirable to allow some accomodation for dimensional differences between locks, it is preferred that the central rod-like member have a small degree of freedom for axial movement. Thus, when the key is used to open a conventional lock whose plunger has a bore that is shorter than in the lock of this invention, abutment of the rod-like member will not prevent frictional engagement of the fingers. This is accomplished by employing a spring under compression in the thumb screw at the end of the rod-like member remote from its working end to allow a small amount of relative movement, floating effect, of the otherwise stationary central rod-like member.

Another feature of the lock of the invention permits installation of the lock without using a key of the kind just described. It has been pointed out that the piston and cylinder parts of the plunger will normally move together and that the piston and cylinder must be separated to some degree before the lock can be opened. In the preferred embodiment of the invention the piston has an enlarged head and a shaft narrower than the head slidingly fitted within the plunger cylinder. When and only when the piston head is in a position away from the cylinder, the locking balls can occupy the area around the piston shaft in the retracted unlocking locations. The lock must of course be in this unlocking condition for installation, and that could be accomplished by using the key of the invention. However, it is desired that installers not have access to the keys for security reasons. The lock accordingly has means keeping the piston and cylinder in their relatively separated unlocked state prior to installation. This is achieved by means of a frangible element holding the piston and cylinder of the plunger in unlocked condition until the frangible element is broken. The frangible member must be strong enough to withstand the force exerted by the locking and tamper prevention springs as well as shocks endured during shipment and handling. It has been found that a breakable pin member fitted in aligned bore holes of the piston shaft and cylinder wall can be used as the frangible element. A thin shear pin of aluminum is presently preferred, but a rod-like piece of graphite can also be effectively used with the advantage of internal lubrication provided by the broken graphite bits after installation. With the frangible pin as the only thing preventing the piston and cylinder of the plunger mechanism from moving into locking condition, the installer merely has to insert the lock shank into the position at which the steel balls are aligned to engage cooperating recesses or grooves and then break the frangible element. A rigid rod inserted through the keyhole of the lock and pushed against a shoulder on the plunger cylinder readily breaks the frangible pin, and the cylinder of the plunger moves immediately to locking position, forcing the steel balls radially outward. After initial installation, the lock will only be opened by those having the authorized key, and the installer has no responsibility for the key, which he never needs to use. If properly sized, the rod used for installation can even be left in place by the installer, serving as a further deterrent to tampering and offering possible advantages to the user for identification as by color coding. A simple plastic rod having a flat head is presently preferred as the installation tool.

A further feature of the invention is the provision of a seal near the keyhole of the lock which is normally closed to prevent the entry of foreign matter, insects and moisture into the lock cavity. A disk of elastomeric material having a slot traversing its center can be employed as the seal, where the material has the property of returning to its original shape after deformation. After removal of the key inserted through the slit, the lips of the slit gradually return to the normal closed position. Various plastics material have this property of "memory".

The lock of the invention can closely resemble conventional locks in outward appearance, and the keyhole aperture is quite small. One seeking to learn the internal structure of the lock, in order to pick it, will not be able to notice differences from conventional locks by visual inspection. But, since the proper key can open not only the lock of this invention, but also the outwardly similar conventional locks, authorized personnel need not be informed by any code or other insignia that the lock they are to open is that of this invention.

Further objects, advantages and structural details of the lock and key of the invention will be more fully understood from the following detailed description of a preferred embodiment of the invention, especially when that description is read with reference to the accompanying drawing figures.

BRIEF DESCRIPTION OF THE DRAWINGS

In the drawings, wherein like reference characters designate like parts throughout:

FIG. 9 is a view in section of the key according to the invention;

FIG. 10 shows the use of the key of FIG. 9 in unlocking the lock of the invention;

FIG. 11 is a sectional view similar to that of FIG. 10 and showing the starting position of the key ready to unlock the lock;

FIG. 12 is a view similr to those of FIGS. 10 and 11 and showing the position of lock and key elements upon engagement for unlocking;

FIG. 13 is a view taken along line 13—13 of FIG. 5 and looking in the direction of the arrows showing a seal member according to the invention;

FIG. 14 is a view taken along line 14—14 of FIG. 5 and looking in the direction of the arrows, showing a frangible pin according to the invention;

FIG. 15 is a view taken along line 15—15 of FIG. 11 and looking in the direction of the arrows, showing steel locking balls in locked condition; and FIG. 16 is a view taken along line 16—16 of FIG. 11, showing a rotation preventing flat on a threaded element of the key.

DETAILED DESCRIPTION OF A PREFERRED EMBODIMENT

Figures 1, 2, 3, 4:
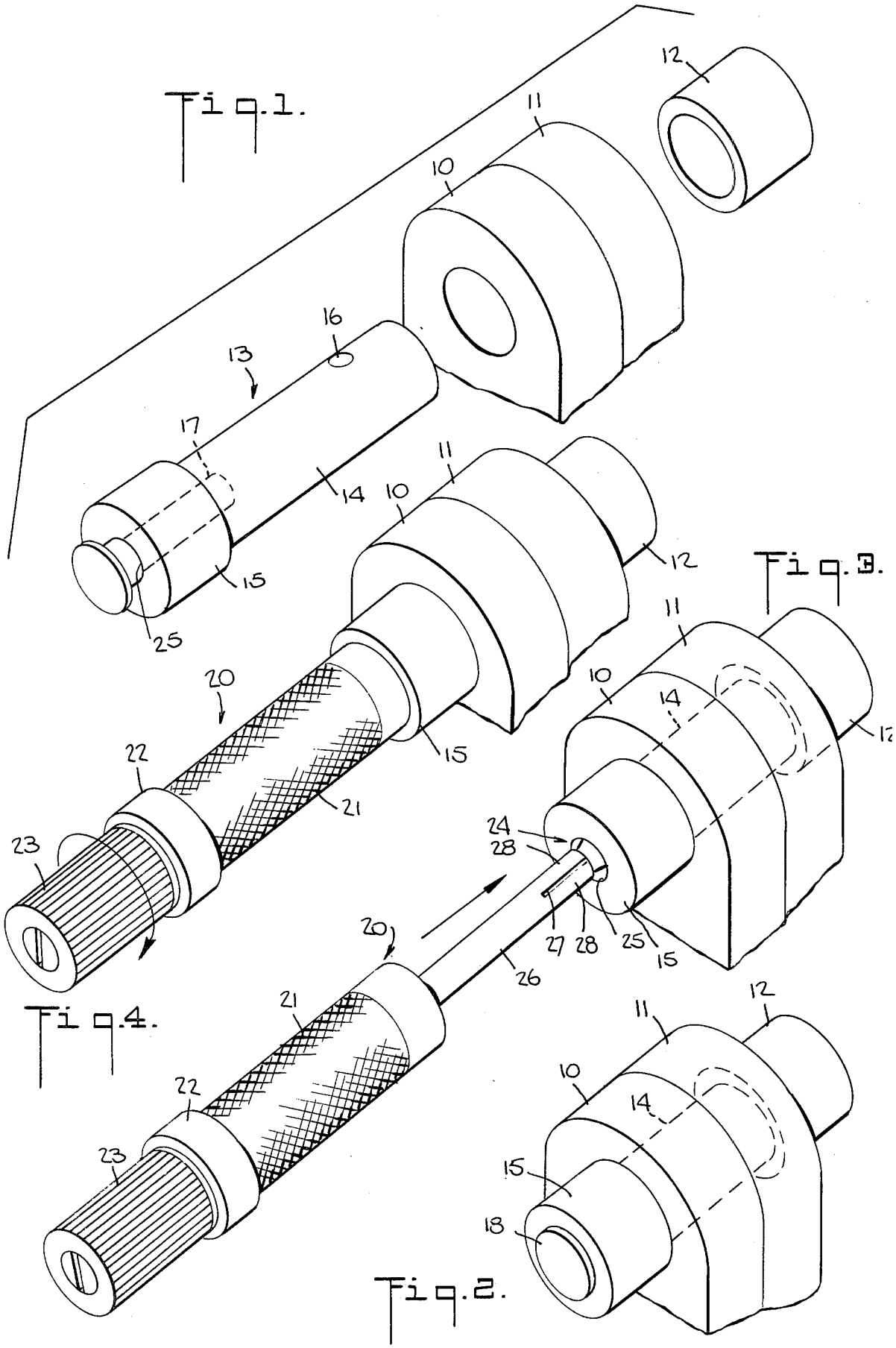
FIG. 1 is an overall view showing the lock of the invention ready for installation through a pair of arms to be held locked together.
FIG. 2 shows the lock of FIG. 1 in installed, locked condition.
FIG. 3 shows the manner of insertion of the key of the invention into the lock of FIGS. 1 and 2.
FIG. 4 shows the unlocking operation of the key by rotation of a thumbscrew in the direction shown by the arrow.

The security lock of the invention is illustrated in the accompanying drawing figures as applied to hold two arms 10 and 11 such as those of a valve or meter in registering relationship by using a removable cap member generally designated by the reference numeral 12. This application is shown for its relative simplicity, but it should not be understood as limiting the applicability of the lock, which can be used for all of the applications in which plunger type locks having retractible steel locking balls ae currently used, as well as other applications wherein radially extending locking members are to be releasably locked in extended position by a plunger-type mechanism. In such application as locking cabinet doors, or other enclosures, the lock would be used without any cap, and instead of the arms 10 and 11, some other means would be engaged by the steel locking balls 16.

As shown in FIGS. 1–4, the arms 10 and 11, which could be the fixed and movable arms of a valve in a pipeline, are held in alignment by the lock of the invention generally designated by reference numeral 13, fitted with the cap member 12. The shank 14 of the lock 13 is passed through aligned bore holes of the arms 10 and 11; and the enlarged head 15 of the lock 13 together with the cap member 12 prevent removal after locking by radial extension of the steel balls 16 into mating recesses of the cap member 12. FIG. 1 also shows part of an installation pin 17 used for initial locking by an installer. The flat head 18 of the pin 17, left in place by the installer as a protective member, appears in FIG. 2 which shows the lock after installation.

FIGS. 3 and 4 show the key, generally designated 20, as it is employed to open the lock 13. The key 20 is shown to have a generally cylindrical knurled handle portion 21 with a fixed cap 22 and a thumbscrew 23 shown as grooved or knurled for easy manipulation. Between the cap 22 and the thumbscrew 23, there is a thrust bearing shown as a washer of polytetrafluoroethylene or similar material. Ball bearings could also be used. The operating end 24 of the key 20, shown at the point of insertion into the keyhole aperture 25 of the lock 13 in FIG. 3, is seen to have an external cylindrical member 26 split by a slot 27 at its end into a pair of fingers 28 of generally semi-circular profile. As will be moe fully described in connection with other figures of the drawing, the fingers 28 are somewhat flexible for outward movement into frictional engagement to open the lock 13.

After insertion of the operating end 24 of the key 20 into the keyhole 25, the thumbscrew 23 is turned as shown in FIG. 4 while the key handle 21 is held stationary to cause the elements of the key to open the lock 13 by releasing the steel balls 16. Ordinarily the key handle 21 will contact the lock end 15 during opening of the lock.

The shank 14 and head 15 of the lock 13 and the cap 12 are preferably formed of hardened steel to deter brute force efforts to remove the lock 13. As shown in FIG. 4, once the lock 13 is locked in place, the only point of attack is the keyhole 25, covered by the head 18 of the installation pin 17. Upon removal of the pin 17, a potential lock-picker looking into the keyhole 25, or probing within the lock, will not be able to ascertain the internal structure or operating mechanism of the lock 13 well enough to know that the lock 13 is not a conventional plunger-type lock. That mechanism is shown in FIGS. 5–8.

Figure 5:
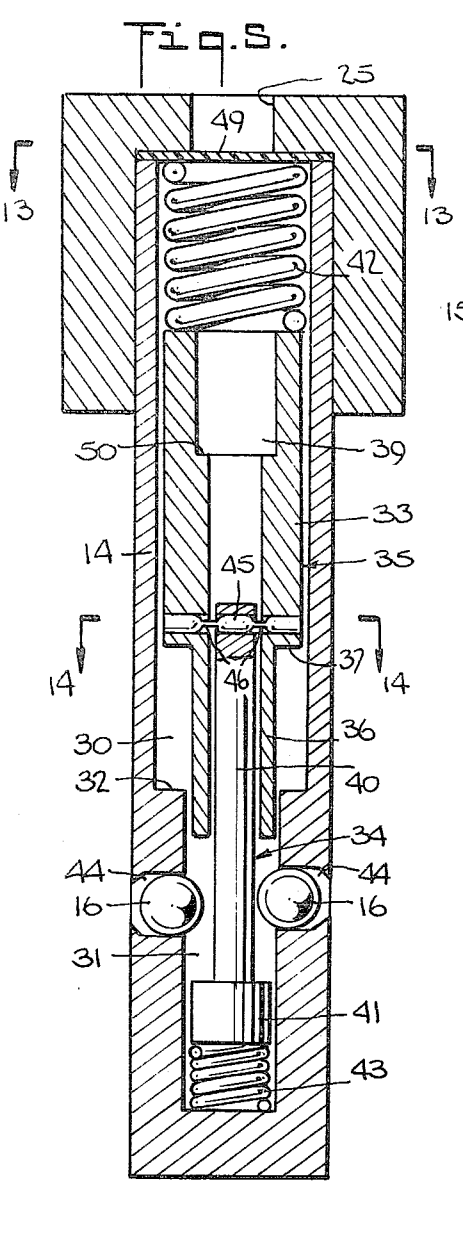
FIG. 5 is a view in section of the lock of the invention before initial installation with a frangible element intact.

FIG. 5 shows the lock 13 as it would be received by an installer, ready for use. The generally cylindrical shank 14 has an axial bore 30, a portion of which bore, shown at 31, is of reduced diameter, providing an internal annular shoulder 32. The shank 14 is closed at one end, shown at the bottom in FIGS. 5–8 and is fitted at its other end with the enlarged head 15 firmly fixed to the shank 14 or integrally formed therewith. The keyhole aperture 25, narrower than the shank bore 30 and aligned therewith, is seen at the top in FIGS. 5–8.

Slidably fitted within the shank bore 30 are a cylinder member 33 and a piston 34 which together constitute the compound plunger mechanism of the lock 13. The cylinder 33 has one portion 35 with an external diameter slightly smaller than the bore 30 and another portion 36 of reduced diameter slightly smaller than the bore at 31, so that movement of the cylinder is restricted by abutment of an external shoulder 37 of the cylinder 33 with the internal shoulder 32. An axial cylindrical bore 38 through the cylinder 33 has an enlarged socket area at 39 for frictional engagment by the fingers 28 of the key 20. An elongated shaft portion 40 of the piston 34 is slidably received within the cylinder bore 38 and the piston has a head 41 of the same external diameter as the smaller end portion 36 of the cylinder 33. The smooth continuous wall provided by the head 41 and cylinder portion 36 prevents re-entry of the balls 16 therebetween.

A relatively strong coiled locking spring 42 is shown compressed between the upper end of the cylinder 33 and the head 15 of the lock pushing down on the cylinder 33, and a smaller anti-tamper coiled spring 43 at the closed end of the shank 14 presses against the head 41 of the piston 34. The smaller spring 43 is shown to be easily overpowered by the locking spring 42 in FIG. 6.

In the pre-installation condition of FIG. 5, the steel locking balls 16 are free to move inwardly, since the piston shaft 40 is considerably narrower than the bore portion 31. It will be seen that the balls 16 are slidably mounted in a diametral bore 44 the inwardly swagged ends of which prevent escape of the balls 16. In this pre-installation condition,, the plunger mechanism consisting of piston 34 and cylinder 33 is extended, in opposition to the force of the springs 42 and 43 tending to force the piston shaft 40 fully into the cylinder bore 38 with the head 41 of the piston abutting the cylinder. The parts are held in this position by frangible pin 45 shown unbroken in FIGS. 5 and 14. The pin 45, which can be of graphite or aluminum, is strong enough to resist the force of the springs 42 and 43, as well as shocks during shipping and handling, but is breakable by the application of force by means of the insertion pin 17. It will be seen that the pin 45, which can have weakened portions 46 for breaking extends through aligned holes 47 and 48 in the cylinder portion 35 and piston shaft 40 respectively, as shown best in the sectional view of FIG. 14. The hole 48 through the piston shaft 40 is preferably located near the end of the shaft 40 to provide considerable extension of the piston 34 out of cylinder 33. Alternatively, an adhesive bond or cooperating interfitted parts of the piston and cylinder could replace the frangible pin 45. If some mechanical interfit of parts is employed instead of the frangible element, the lock may be returned to its pre-installation condition.

Also shown in FIGS. 5–8 is a flexible seal member 49 closing the keyhole 25. This seal 49 and its function will be described in greater detail hereafter in conjunction with FIG. 13.

Figure 6:
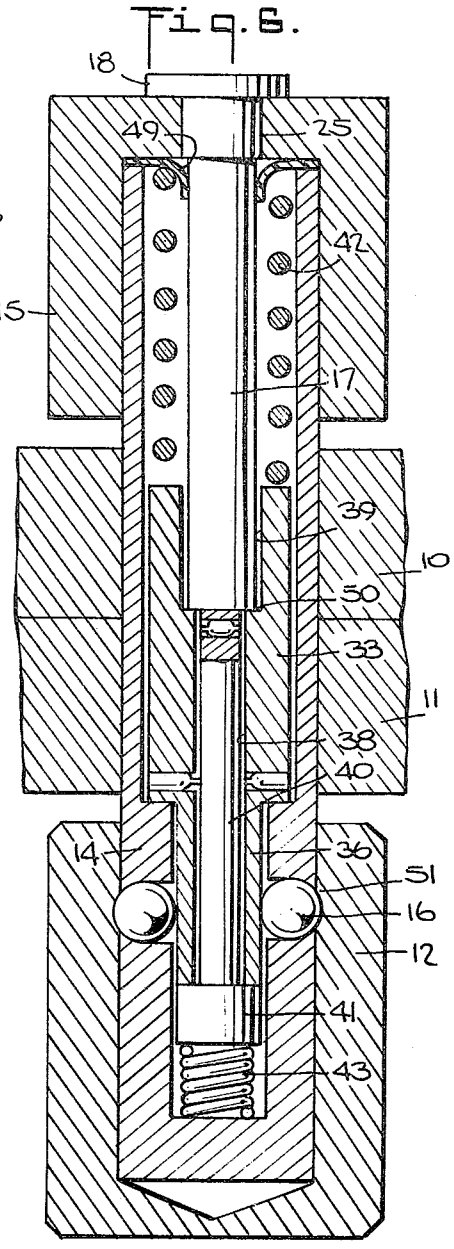
FIG. 6 is a view similar to FIG. 5 showing the effect of inserting an installation pin to break the frangible member.

FIG. 6 shows the lock 13 installed and locked by means of the installation pin 17. It has been mentioned that the cylinder bore 38 terminates in a socket 39 of enlarged diameter. At the point where the bore 38 widens there is an annular ledge 50, and it is the ledge 50 which is engaged by the installation pin 17 in breaking the frangible member 45 for actuation of the lock 13. It will be noted that the keyhole aperture 25 is slightly larger in diameter than the cylinder bore 38, so that the installation pin 17 can pass through the keyhole 25, but cannot enter the cylinder bore 38. Upon insertion, the pin 17 encounters the ledge 50 and the application of force breaks the pin 45 allowing the piston 34 and cylinder 33 to butt together under the urging of the springs 42 and 43, into the condition shown in FIG. 6. In this condition the steel locking balls 17 are forced outwardly and held in locked position by the portion 36 of the cylinder. The cap 12 shown to illustrate one manner in which the lock of the invention may be used has an internal circumferential groove 51, into which the balls 16 are received. A cross-sectional view of the locked balls is shown in FIG. 15.

The broken pin 45, portions of which are retained in the holes 47 and 48, having served its function, does not interfere with operation of the lock. The installation pin 17, which is preferably of some hard plastic, although any rigid, thin article of sufficient length can serve for breaking the pin 45, is left in place until the lock is to be unlocked.

Figure 7:
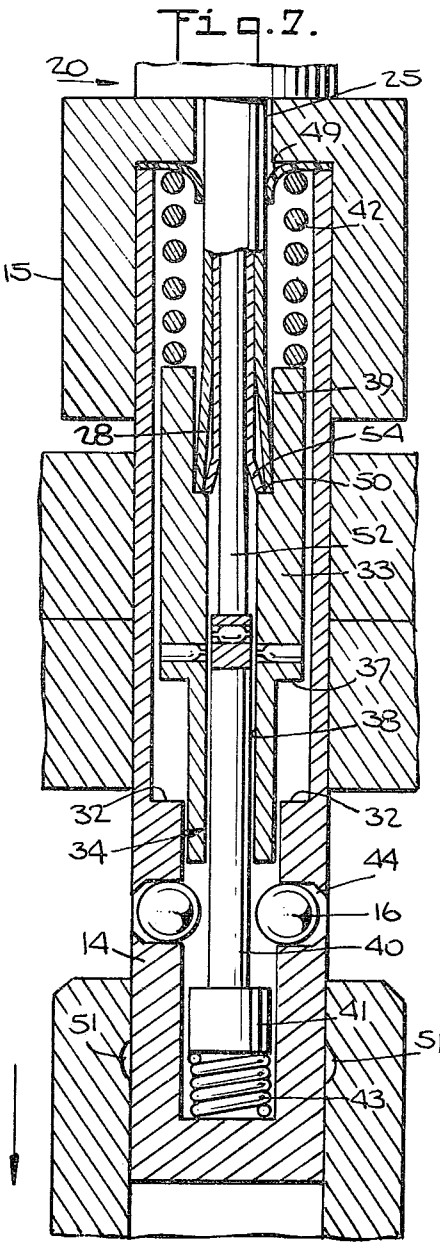
FIG. 7 is a view similar to those of FIGS. 5 and 6 showing the operation of the key in unlocking.

The unlocking operation is illustrated in FIG. 7., showing the withdrawal toward the head 15 of the lock 13, of the cylinder 33 while the piston 34 is restrained against following the cylinder 33 by a rod-like member 52 of the key 20. While this rod-like member 52 holds the piston 34 down, expanded fingers 28 of the key 20 in tight frictional engagement with the wall of the cylinder socket 39 are pulled outwards, drawing the cylinder 33 into a retracted position against the force of the locking spring 42. The working parts of the key 20 will be more fully described with reference to FIGS. 9–12. At this point it should be emphasized that in order to open the lock 13, the cylinder 33 must be retracted retracted against the force of the locking spring 42 while the piston 34 is held back from following the cylinder 33 as it is urged to do by the anti-tamper spring 43. Accordingly, the lock can only be opened by exerting force to hold the piston 34 in place while simultaneously retracting the cylinder 34 to open up a space between the piston 34 and cylinder 33 into which the steel balls 16 can retreat as shown in FIG. 7 to disengage from a cooperating groove or recess.

Figure 8:
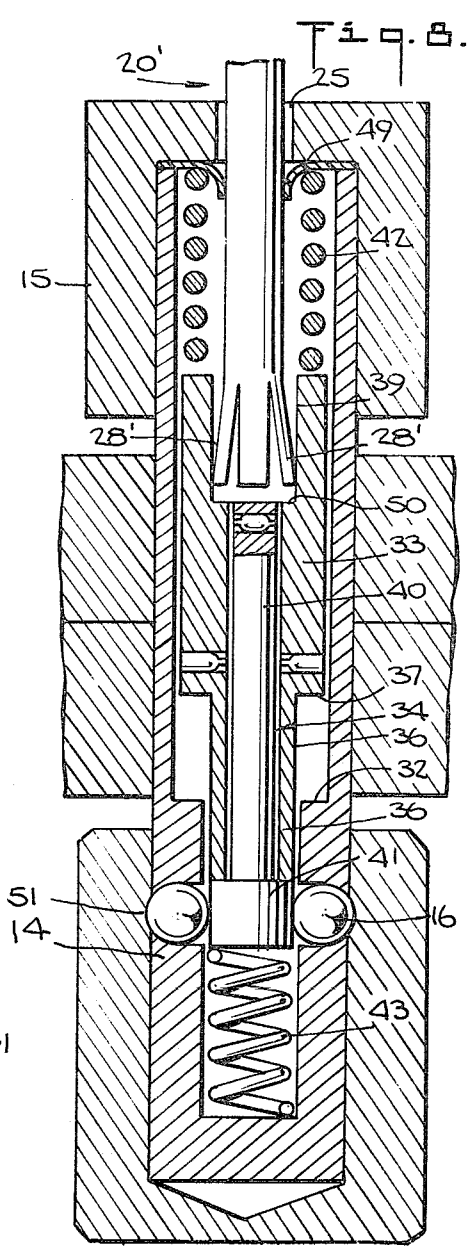
FIG. 8 is a view similar to those of FIGS. 5–7 and showing the ineffectiveness of using a prior art key to open the lock.

FIG. 8 illustrates what would happen if a key 20' without any stationary central rod were used in an attempt to open the lock. Fingers 28' of the incorrect key could frictionally grip the interior of the cylinder socket 39 and by pulling the key 20' outward the cylinder 33 could be retracted, but with nothing holding the piston 34 in place, the piston 34 would follow the cylinder 33, and the piston head 41 would move into the blocking position previously occupied by the portion 36 of the cylinder 33 and blocking against retreat of the balls 16. Any bent wire or nail that could retract the cylinder 33 would also be ineffective, since the condition of FIG. 8 would result upon retraction of the cylinder 33 by such means.

The key 20 of the invention and its operation are illustrated in FIGS. 9–12. It will be seen that the central rod-like member 52 which holds the piston 34 stationary during opening of the lock 13 extends along almost the entire length of the key 20. The operating end of the rod-like member 52 is closely but slidably embraced by a tubular sleeve 53 having a flared or bell-like end portion 54. Concentrically encompassing the tubular sleeve 52 there is a cylindrical member 55, split by a diametral cut at its operating end into a pair of fingers 28 generally semi-circular in profile. The cylindrical member 55 is somewhat flexible material so that when the flared end portion 54 of the tubular sleeve 53 is drawn up between the fingers 28 and the central rod-like member 52, the fingers 28 move outward and away from each other to assume the socket engaging positions shown in FIG. 10. The mechanism for actuating the operating elements of the key 20 includes a thumbscrew 23 and associated means housed within the handle portion 21 of the key 20.

The thumbscrew 23 has internal threads as shown at 56 in screw engagement with external threads 57 of a generally cylindrical element 58 secured to the tubular sleeve 53 and axially movable therewith. The member 58 has a stepped radially extending lip 59, and a coiled spring 60 surrounding the member 58 betwee the step 59 and the interior of the key cap 22 opposes motion of the members 58 and 53 toward the thumbscrew 23. The tubular sleeve 53 tends toward full extension to the position beyond the fingers 28 shown in FIG. 9. A flat at 61 on the threaded portion 57 of the member 58 coacts with a flat edge 62 of an otherwise round hole 63 in the key cap 22 to prevent rotation of the member 58 along with the thumbscrew 23 so that rotation of the thumbscrew 23 draws the member 58 and the tubular sleeve 53 toward the thumbscrew 23 against the opposition of the spring 60 so that the flared end 54 spreads apart the fingers 28. The cooperating flats are best seen in FIG. 16.

The split cylinder 55 which constitutes the fingers 28 is also movable toward the thumbscrew 23 when the members 53 and 58 have moved in the upward direction in FIG. 9. Attached to, or integrally formed with, the upper end of the cylindrical member 55 is a generally annular nut-like element 64 with a radially extending rim 65. A coiled bias spring 66 extends between the rim 65 and the key cap 22 for purposes similar to those of the spring 60, but the spring 66 is stronger than the spring 60. The spring 66 compensates for variations in the diameters of cylinder sockets.

FIG. 11 shows the key 20 in starting position, ready to begin unlocking operation. The operating elements of the key have been inserted through the keyhole 25 and the central rod-like member 52 is ready to make contact with the outer end of the piston shaft 40 within the socket 39 of the cylinder 33. The flared end 54 of the tubular sleeve 53 is too large to enter the cylinder bore 38 and accordingly abuts against the shoulder 50. At this point the operator of the key would feel contact and would begin rotating the thumbscrew 23. The diameter of the central rod-like member 52 is equal to or smaller than the diameter of the piston shaft 40, and in no case can it be larger than the cylinder bore 38.

As the thumbscrew 23 is turned, the working parts move toward the condition of FIG. 10. Before achieving the unlocked situation of FIG. 10, the transitional stage of FIG. 12 occurs. It will be seen that in FIG. 12, the stationary rod member 52 is holding back the shaft 40 of the piston 34 while the flared end portion 54 of the sleeve 53 has been drawn upward spreading apart the engagement fingers 28 into contact with the wall of the cylinder socket 39. At the stage shown in FIG. 12, the fingers 28 and cylinder 33 are in tight frictional contact, but retracting motion has not yet commenced. Once the fingers 28 have been wedged between the wall of the socket 39 and the flared end 54, the fingers 28 must follow the retracting travel of the members 58 and 53, to assume eventually the unlocked position of FIG. 10, whereupon the balls 16 are free to retreat.

Variations in the diameter of the key's central rod-like member 52 and the length thereof can be employed to limit keys to opening only certain locks according to the invention, so that a family of locks with piston shafts 40 of different dimensions can be provided, with the result that not all keys will open all of the locks.

It will be understood that the key 20 will serve to unlock plunger type locks of conventional types that do not have a spring loaded following piston, since in opening such locks, the outward spreading of the fingers 28 would cause engagement as usual and without further turning of the thumbscrew 23 the key handle could simply be pulled outward to open the lock. Because the key 20 may be used to open other locks than that of this invention, and to accomodate the variations of dimensions in existing locks, it is desirable to allow some degree of adjustment in the distance that central rod member 52 projects beyond the end of the tubular sleeve 53. When the key is used to open a conventional lock that has a one piece plunger, the central rod-like member 52 can adjust itself by retracting slightly so that the fingers 28 remain within the plunger bore. This is achieved by providing a small coiled spring 70 or other resilient member between an enlarged head 71 of the rod-like member 52 and a screw cover 72 in a small cylindrical well 74 centrally located in the thumbscrew 23. The rod-like member 52 can accordingly "give" slightly when necessary. The screw cover 72 can be adjusted to limit the amount of adjustment allowed. The spring 70 is strong enough to overpower the anti-tamper spring 43 of the lock (FIGS. 5–8) so that the piston 34 does not push back the rod-like member 52 in unlocking operation.

FIG. 13 shows a seal member 49 for the keyhole 25 to prevent infiltration of the lock 13 by foreign matter and/or insects and/or moisture. The seal 49 is simply a flat disk of elastomeric material such as a "memory" plastic, with a slot 75 extending across its center permitting insertion through the slot 75 of the installation pin 17 or the operating end of the key 20. Upon withdrawal of pin 17 or key 20 the disk resumes its flat condition. The disk 40 is positioned between the shank portion 14 of the lock 13 and the head 15 with its periheral area tightly held in place as shown in FIGS. 5 and 13. Since the seal member 49 is recessed behind the keyhole 25 it is difficult for a lockpicker to pry open the slot to see the lock's interior without blocking his view with the tool employed. Destruction or damage to the seal member 49 will give evidence of possible tampering. The seal disk 49 can, of course, be omitted without affecting operation of the lock 13, but its use is recommended.

The seal disk 49 can optionally be color coded for lock identification.

Various modifications, substitutions of equivalent parts and the like will suggest themselves to those familiar with locks, and are considered to be within the spirit and scope of the invention. For example, an adhesive attachment of the piston 34 to the cylinder 33 could be used in place of the frangible pin 45, so long as the adhesive bond can be readily broken upon installation. Another modification might be the use of a piece of resilient solid material, such as foam plastic or sponge rubber, in place of the anti-tamper spring 43. A minor change could be made by providing a recess around the keyhole 25, allowing the head 18 of the insertion pin 17 to lie parallel with the surface of the lock head 15 making removal harder, or some other means could be employed to cover the keyhole 25. Finally, some other mechanical actuating mechanism might replace the thumbscrew 23 and associated mechanical elements to provide the relative movement of spreading parts at the tip of the key.

We claim:

1. A lock having a generally cylindrical body with an axial bore and spring loaded plunger means movable within the bore for holding extensible locking members in extended position, said plunger means including a first part retractible by use of expanding key means and a second part biased to follow said first plunger part upon retraction thereof, so that said second part must be restrained against motion to release the locking members.

2. The lock of claim 1 wherein said second part is normally forced toward said first part by spring means.

3. The lock of claim 1 wherein said first plunger part has an axial bore hole and said second plunger part has a shaft slidably received within said bore hole and a head larger than said bore hole.

4. The lock of claim 1 wherein said second part is biased to follow the first part by spring means weaker than the spring loading said plunger means.

5. A lock having a generally cylindrical shank, radially extendible locking members, a spring loaded plunger mechanism for actuating the locking members, said plunger mechanism comprising a cylinder and a piston movable with respect to said cylinder from an unlocked condition in which a head of said piston is spaced from the cylinder to a locked condition in which the head of the piston is in contact with the cylinder, and frangible means holding said piston in unlocked position until installation of the lock by breaking the frangible means.

6. The lock of claim 5 wherein the piston has a shaft slidably mounted within an axial bore of the cylinder, and wherein the frangible means is a pin extending through said shaft and into engagement with said cylinder.

7. The lock of claim 5 wherein the piston is urged toward locked condition by spring means engaging the head of the piston.

8. The lock of claim 5 wherein a keyhole in one end of the shank permits access to the cylinder, and an installation pin slidable through said keyhole into contact with said cylinder for breaking said frangible means is retained in said keyhole after breaking said frangible means.

9. A key for a plunger-type lock having a central rod-like element, an elongated tubular sleeve concentric with and slidable along said rod-like element, said tubular sleeve having an enlarged end, a plurality of relatively flexible fingers positioned radially outward of said sleeve, and means for moving said enlarged end between the rod-like element and the fingers to force said fingers radially away from said rod-like member.

10. The key of claim 9 wherein said fingers are arcuate in profile and are carried by a cylindrical element co-axial with said rod-like member and said sleeve and slidable with respect to said sleeve.

11. The key of claim 9 wherein said rod-like member remains generally stationary in use and said tubular sleeve is retracted along said rod-like member from a starting position at which said enlarged end is adjacent an end of said rod-like member to a position at which said enlarged end is spaced away from the end of and within the length of said rod-like member.

12. The key of claim 9 and including screw means for moving the sleeve with respect to the rod-like member.

13. The key of claim 9 wherein said fingers are movable in a longitudinal direction with respect to said rod-like member after said movement of the fingers radially away from the rod-like member.

14. A key having a handle portion, an elongated rod-like member extending from said handle portion, finger means extending generally parellel to said rod-like member to terminate in finger ends, said finger ends normally lying adjacent an end of said rod-like member, and means movable with respect to said rod-like member for spreading said finger ends apart and for drawing said finger ends in spread condition toward said handle portion for unlocking a plunger type lock.

15. The key of claim 14 wherein the means for spreading said finger ends comprises an element movable toward said handle portion to wedge the finger ends radially outward away from an axis of the rod-like member.

16. The key of claim 14 wherein the handle portion carries means for actuating means to spread said finger ends.

17. The key of claim 14 wherein the length of said rod-like member extending from said handle portion is adjustable to accomodate variations in lock dimensions.

18. The key of claim 17 wherein spring means associated with said rod-like member permits said adjustment of length by allowing some retraction of the rod-like member when axial force is applied thereto.

19. A plunger-type lock comprising a shank having an internal spring loaded plunger for keeping extensible locking members in extended condition; said plunger having a cylinder part which must be retracted from a first position thereof to free said locking members for retreat of the locking members to unextended condition, and a plunger piston part, means urging said piston part from one piston position corresponding to said first position of said cylinder part to follow the motion of said cylinder part upon retraction thereof, said piston part having a head portion which blocks retreat of said locking members when the piston part follows the cylinder part, so that for unlocking a key must be used that has a stationary member holding the piston part in said one piston position while other key elements retract the cylinder part from its said first position.

20. The lock of claim 19 including means holding said piston part against following said cylinder part, prior to installation of the lock.

21. The lock of claim 19 wherein a keyhole aperture of the lock is normally sealed against entry of foreign matter into the lock by a seal member of elastomeric material having a slit for insertion of a key.

22. The lock of claim 19 wherein the cylinder part has an axial bore and the piston part has a shaft slidable within said bore for separation of the piston and cylinder parts by pushing on said shaft while pulling on said cylinder part.

23. A plunger-type lock and key wherein the lock comprises a shank having an internal spring loaded plunger for keeping extensible locking members extended condition; said plunger having a cylinder part which must be moved from a first position thereof to free said locking members for retreat of the locking members to unextended condition, and a plunger piston part, means urging said piston part to follow the motion of said cylinder part from one piston position corresponding to said first position of said cylinder part upon retraction of said cylinder part, said piston part having a head portion which blocks retreat of said locking members when the piston part follows the cylinder part; and the key having a central rod-like element for restraining said piston part against following said cylinder part, a tubular sleeve slidable along said rod-like member, said tubular sleeve having an enlarged end, a plurality of flexible key fingers positioned radially outward of said sleeve for frictional engagement of said cylinder part to retract said cylinder part while said rod-like element restrains said piston part.

* * * * *